United States Patent [19]

Rasmussen

[11] Patent Number: 4,672,774

[45] Date of Patent: Jun. 16, 1987

[54] WINDOW TO BE USED AS A SKYLIGHT OR A FRONT WINDOW

[75] Inventor: Villum B. K. Rasmussen, Klampenborg, Denmark

[73] Assignee: V. Kann Rasmussen & Co., Denmark

[21] Appl. No.: 785,877

[22] Filed: Oct. 9, 1985

[30] Foreign Application Priority Data

Oct. 15, 1984 [DK] Denmark ..... 4931/84

[51] Int. Cl.[4] ..... E06B 3/34

[52] U.S. Cl. ..... 49/371; 49/155; 49/176; 49/129; 49/386

[58] Field of Search ..... 49/371, 125, 127, 129, 49/155, 176, 358, 386

[56] References Cited

U.S. PATENT DOCUMENTS

| | | | |
|---|---|---|---|
| 1,530,610 | 3/1925 | Ortleb | 49/176 |
| 2,394,982 | 2/1946 | Carl | 49/155 |
| 4,064,649 | 12/1977 | Rasmussen et al. . | |
| 4,324,072 | 4/1982 | Sterner, Jr. | 49/260 X |
| 4,416,094 | 11/1983 | Bugener et al. | 49/386 X |
| 4,430,770 | 2/1984 | Niekrasz et al. | 49/386 X |

*Primary Examiner*—Kenneth Downey

*Attorney, Agent, or Firm*—Scully, Scott, Murphy & Presser

[57] ABSTRACT

A window to be used as a skylight or a front window and comprising a frame (1) and two window wings (2, 3) situated above one another on the outside of said frame and being pivotably openable about mutually parallel, especially horizontal axes (17, 18), and which in their open positions can be situated closely below one another in the upper opening of the frame. The two window wings (2, 3) are mutually separated and separately movable and are positioned completely outside the frame (1) both in their closed as well as in their open positions.

In this manner a window is obtained which is inexpensive to manufacture and which allows many adjustment possibilities including a completely open position with a clear view and a great emergency exit, and where the loads on each wing are relatively insignificant.

7 Claims, 7 Drawing Figures

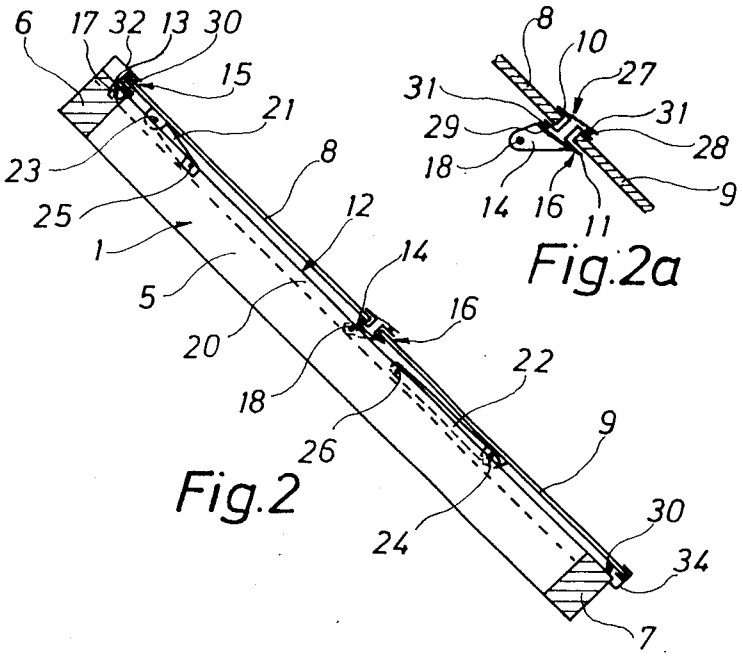
Fig.2a
Fig.2
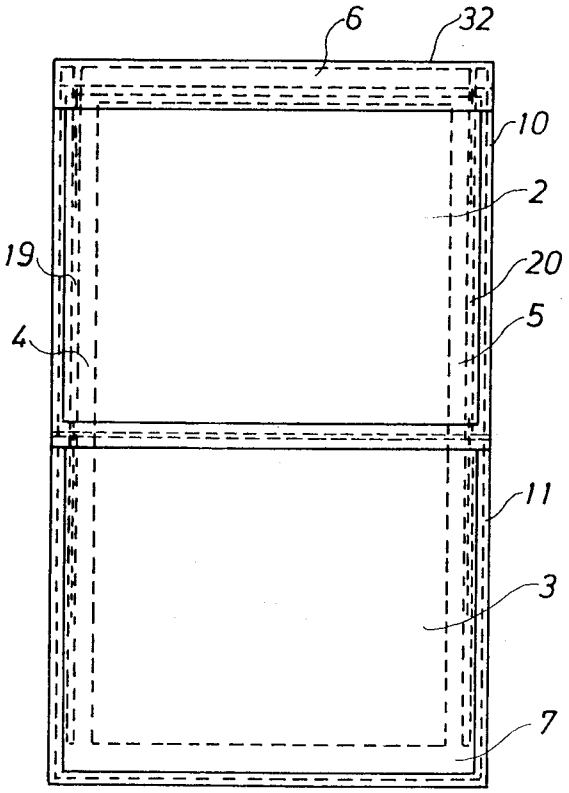
Fig.1

WINDOW TO BE USED AS A SKYLIGHT OR A FRONT WINDOW

FIELD OF THE INVENTION

The invention relates to a window to be used as a skylight or a front window and comprising a frame and two window wings situated above one another on the outside of said frame and pivotably openable about mutually parallel, especially horizontal axes and which in their open positions are capable of being positioned closely below one another in the upper opening of the frame.

DESCRIPTION OF THE PRIOR ART

For a long time an uncovered demand has existed for a window releasing or supplementing especially the known front windows of the hoisting type whereby a lower sash is hoisted behind an upper sash, but whereby the resulting opening is not always sufficiently great for fulfilling the requirements to an emergency exit for instance in connection with fires and normally required in many countries. Furthermore a demand exists for a possibility of supplementing the known skylights of the type comprising a top suspended sash with an emergency exit where a particular desire applies for a possibility not only of restricting the requirements to the strength of the moving means but also of improving the light conditions and the clear view through the window.

The above demand has been fulfilled to a certain degree by the window disclosed in German patent specification No. 746,999. This window is, however, only suited as a front window. It comprises an upper sash tiltable about two pivots situated on a horizontal axis, said pivots being fixedly mounted in the frame. Furthermore the window comprises a lower sash tiltable in a similar manner about two pivots situated on a horizontal axis, said pivots also being fixedly mounted in the frame but simultaneously being displaceable in grooves in the side members of the frame in a direction towards and away from the bearings of the upper sash. Along their frame members abutting one another in the closing position the two sashes are interhinged in such a manner that their opening and closing movements occur in a mutually coercively controlled manner and furthermore in such a manner that in the completely opened position the sashes are assembled closely below one another at the bearing of the upper sash in the frame. This window is an improvement relative to the known sash windows concerning the size of the emergency exit, but as to the light conditions they provide no improvement nor an indication of how to solve the sealing problems in a satisfactory manner. In addition, the tilting movement used may cause problems as a consequence of the inward movements of the sashes.

SUMMARY OF THE INVENTION

Based on the above prior art the two window wings of the window according to the invention are mutually separated and separately movable, and which both in the open and in the closed state are positioned completely outside the frame. In this manner the weight and the wind pressure on each window wing are reduced and consequently less restrictive requirements are presented to the strength of the moving members as well as to the forces to be exerted when handling the moving members compared to the previously known windows.

Moreover the manufacture is thereby less expensive. A further result is an increase of the number of adjustment possibilities as it is possible either to open the upper wing alone or both the upper and the lower wind in order to ventilate more or less while simultaneously ensuring a good protection against rain through the open window. Finally when both wings are open it is possible to move the lower wing upwards below the upper wing so as thereby to ensure a clear view and a great emergency exit.

According to the invention it is preferred that the window wings are top suspended and mounted in the frame by means of hinges of the type allowing a polishing of the outer side of the upper wing from the inside. In this manner an advantageous embodiment is obtained which allows an advantageous positioning of the window wings in their open state and thereby an easy access to a polishing of the outer sides of the window wings.

When the windows are balanced for instance by means of gas springs operating between the frame and the hinges, an easy movement of the moving members and a stabilization of the chosen adjustment of the wings are ensured.

A particularly advantageous embodiment of the window can be obtained by the window wings being one or more layers of glass with a sash of metal such as double-glazings with an aluminium sash, and by the glass pane resting completely or partially directly on the outer side of the frame in the closed state of the window including an intermediary packing. Such an embodiment can be carried out in such a manner that it is particularly light and relatively inexpensive and furthermore easy to keep in large order at the same time as it provides a large light area and allows a good sealing against penetrating water, draft, and waste of heat. The interfering rim effect in the form of inner formation of dew often applying to double-glazings and inter alia being due to the effect of the metal sash as a thermal bridge is simultaneously completely or partially eliminated as the metal sash is situated a distance outside the line of packing in such a manner that the thermal bridge is positioned a distance outside the visual area. The mutual sealing between the two window wings may according to the invention advantageously be obtained by the lower rim portion of the upper wind overlapping the upper rim portion of the lower wing in the closed state of the window, and by at least one packing being inserted between said rim portions. In order to eliminate the effect of the doubleglazing rim additionally at the connection between the two window wings the profile of the metal sash may be shaped with an interrupted thermal bridge.

BRIEF DESCRIPTION OF THE DRAWING

Additional details and advantages by the window according to the invention appear from the following explanation fo embodiments with a reference to the accompanying drawing, in which FIG. 1 is a view from the outside of a window according to the invention with closed window wings, FIG. 2 is a vertical sectional side view through the window of FIG. 1, FIG. 2*a* illustrates on a larger scale a fractional view of the connection between the two window wings, FIG. 5 shows the embodiment of FIG. 4, but whereby the lower window wing is pulled upwards below the upper window wing, and FIG. 6 is a further embodiment of a window according to the invention to be mounted as a front window.

DESCRIPTION OF THE PREFERRED EMBODIMENTS

Figure 4:
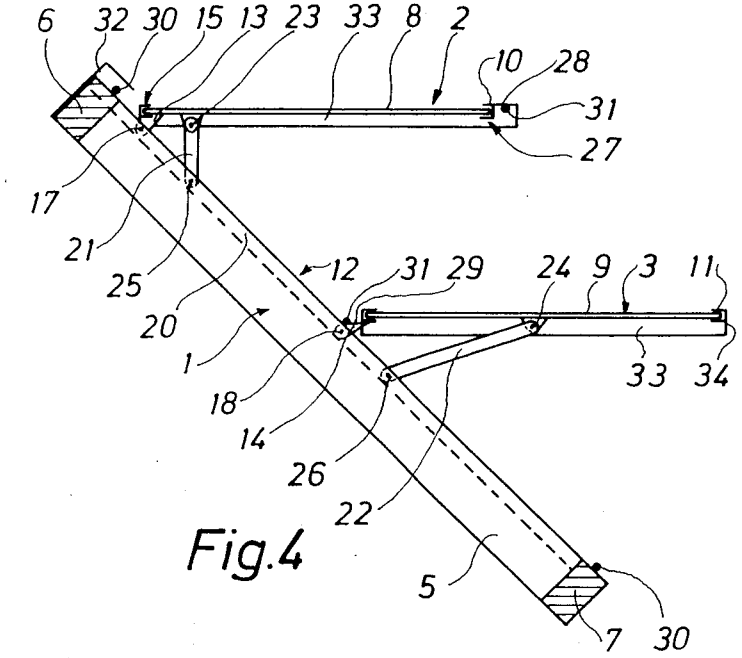
FIG. 4 shows the embodiment of FIG. 3, but whereby both window wings are open.
Figure 3:
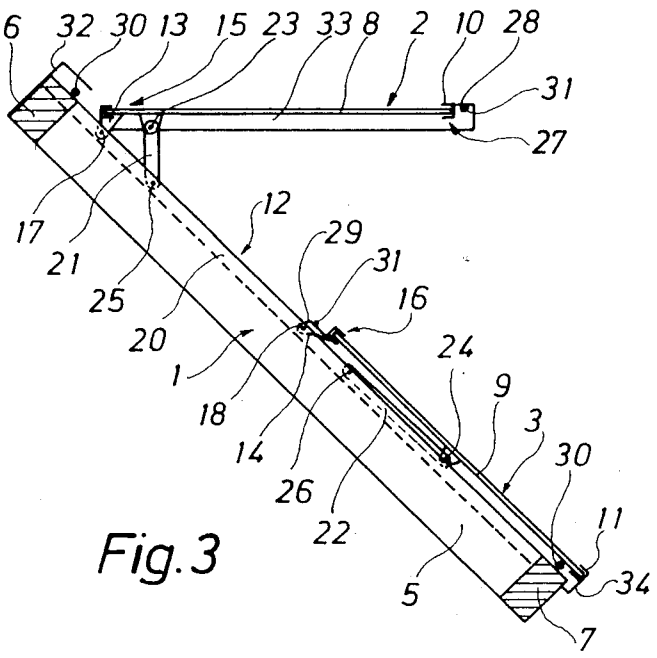
FIG. 3 shows the embodiment of FIG. 2, but whereby the upper window wing is open.

FIGS. 1 to 5 illustrate a window according to the invention to be mounted in an inclined roof surface. The window comprises a frame 1 with an upper widnow wing 2 and a lower window wing 3, respectively, mounted thereon. FIGS. 1 to 2*a* illustrate the window with closed window wings whereas FIGS. 3 and 4 illustrate the window with an open upper window wing 2 and with both window wings 2, 3 open, respectively. FIG. 5 illustrates the window with both window wings 2, 3 open and with the lower window wing 3 pulled upwards into a position closely below the upper window wing 2 in such a manner that a large free passage is formed below the lower window wing 3. This passage allows a clear view below the window wings and can be used as an emergency exit. The frame 1 comprises two side members 4, 5, a top member 6, and a bottom member 7. Both window wings 2, 3 are double-layer double-glazings 8, 9 with their respective aluminium sash 10, 11. The two window wings are mounted on the outer side 12 of the frame by means of hinges 13, 14 secured to the aluminium sashes 10, 11 of the window wings at the upper rim portions 15, 16 thereof. At the ends facing away from the window wings the hinges 13, 14 are pivotably mounted about pivots 17, 18 displaceable in longitudinal guides 19, 20 in the side members 4, 5 of the frame. The guides 19, 20 in the side members 4, 5 of the frame are shaped as grooves with the opening positioned in the outer side 12 of the frame and facing the window wings. Furthermore links 21, 22 are pivotably mounted between the two window wings 2, 3 and the frame 1. The links 21, 22 are at one end suspended on pivots 23, 24 secured to the aluminium sashes 10, 11 and at the opposite end suspended on pivots 25, 26 in the guides 19, 20. Thus the two window wings are top suspended and pivotably openable about parallel, horizontal axes through the hinges 17, 18. The window wings are handled by means of handles known per se and moving members (now shown) transferring the movement to the hinges 13, 14 and the links 21, 22 of the window wings. The pivot 25 extending through the lower end of the link 21 is permanently mounted in the guide 19, 20 in the frame 1. By opening this wing 2, the pivot 17 and consequently the hinge 13 and the upper rim portion 15 of the window wing are displaced downward parallel to the guide 19, 20 in such a manner that a space arises between the top member 6 of the frame and the upper rim portion 15 of the window wing. This spacing is sufficiently large to allow cleaning therethrough of the outer side of the window wing 2. By operating the handle of the lower window wing 3, the latter turns initially about the hinge pivot 18 and the pivot 26 at the same time as the hinge 14 is slightly displaced upwards in the guide 19, 20, and not until the wing 3 is completely open, cf. FIG. 4, an additional activation of the moving members of the window wing 3 causes a displacement of the entire wing from the position shown in FIG. 4 into the position shown in FIG. 5 where the lower window wing 3 is positioned closely below the upper window wing 2. As illustrated in FIG. 2*a* the aluminium sash 10 of the upper window wing comprises on the outer side a projecting web 28 at the lower rim portion 27 of the lower wing. In the closed state of the two window wings the web covers the aluminium sash 11 on the upper rim portion 16 of the lower wing. Correspondingly, the lower window wing 3 comprises on the inner side a projecting web 29 at its upper rim portion 16 on the aluminium sash 11. In the closed state of the window wings this web 29 covers the aluminium sash 10 of the upper window wing 2 on the lower rim portion 27. For a sealing of the window when the window wings 2, 3 are closed, a packing 30 is sucured along the circumference of the frame on the outer side 12 of said frame, said packing 30 being positioned inside the guides 19, 20 at the side members 4, 5 of the frame. Correspondingly, packings 31 are provided between the projecting webs 28, 29 and the second window wing 3, 2, respectively, at the connection between the upper window wing 2 and the lower window wing 3. Furthermore the window is provided with a top covering 32 as well as side coverings 33 and a bottom covering 34.

The window shown in FIG. 6 for a vertical handling in a front wall is in principle shaped in the same manner as the embodiment of FIGS. 2 to 5. In the embodiment of FIG. 6 the opening angles of the window wings may be somewhat greater than in connection with a skylight, and the coverings may be slightly differently shaped, e.g. with an additional downward covering web 35 at the lower rim of the lower window wing 3. Besides the explanation of FIGS. 1 to 5 applies to the embodiment of FIG. 6.

I claim:

1. A window assembly, comprising:

a frame including a top, a bottom and first and second lateral sides;

an upper window wing having a top edge located adjacent the top of the frame;

means connecting the upper window wing to the first and second lateral sides of the frame for pivotal movement about a first axis between open and closed positions, and including (i) a first link having a first end pivotally connected to the upper window wing, and a second end connected to the frame for pivotal movement about a second axis fixed relative to the frame, and (ii) a first hinge connected to the upper window wing, above the first link, and connected to the frame for sliding movement along one of the lateral sides thereof to move the top edge of the upper window wing away from the top of the frame and towards the bottom thereof to thereby produce a space between the top of the frame and the top edge of the upper window wing as the upper window wing is moved from the closed position to the open position;

a lower window wing located below the upper window wing; and means connecting the lower window wing to the first and second lateral sides of the frame for pivotal movement about a third axis, parallel to the first axis, between open and closed positions, and supporting the lower window wing for sliding movement along the frame toward and away from the upper window wing when the first and second window wing are in their open positions.

2. A window assembly according to claim 1, wherein:

the first lateral side forms a longitudinal groove;

the means connecting the upper window wing to the first and second lateral sides further includes (iii) a first connecting member supported for sliding movement along the longitudinal groove; and the first hinge is connected to the first connecting member for movement therewith along the longitudinal groove, and fixed to the upper window wing for movement therewith.

3. A window assembly according to claim 2, wherein:

the means connecting the upper window wing to the first and second lateral sides further includes (iv) a flange fixed to the upper window wing, and (v) a second connecting member connected to the frame on the second axis;

the first end of the first link is pivotally connected to the flange; and the second end of the first link is connected to the second connecting member for pivotal movement about the second axis.

4. A window assembly according to claim 3, wherein the means connecting the lower window wing to the first and second lateral sides of the frame includes:

a second link having a first end pivotally connected to the lower window wing, and a second end connected to the frame for pivotal movement about the third axis, and for sliding movement along one of the lateral sides of the frame; and a second hinge connected to the lower window wing, and further connected to the frame for pivotal movement about a fourth axis, above the lower window wing, and for sliding movement along one of the lateral sides of the frame.

5. A window as claimed in claim 1, wherein the window wings are balanced for instance by means of a gas spring operating between the frame and the hinge.

6. A window as claimed in claim 1 or 5, wherein the window wings comprise one or more layers of glass with a sash of metal such as double-glazings with an aluminum sash, and wherein in the closed positions of the window wings and with an intermediate packing the glass panes are resting completely or partially directly on the outer side of the frame.

7. A window as claimed in claim 5, wherein the lower rim portion of the upper wing overlaps the upper rim portion of the lower wing in the closed positions of the window wings, and wherein at least one packing has been inserted between the rim portions.

* * * * *

UNITED STATES PATENT AND TRADEMARK OFFICE

CERTIFICATE OF CORRECTION

PATENT NO. : 4,672,774

DATED : June 16, 1987

INVENTOR(S) : Villum B. K. Rassmussen

It is certified that error appears in the above-identified patent and that said Letters Patent is hereby corrected as shown below:

Figures 5 & 6 should be added to the Patent (attached)

Column 2, line 34: "in large order " should be --in good order--.

Column 2, line 46: "upper wind overlapping" should be --upper wing overlapping--.

Column 3, line 13: "widnow" should be --window--.

Signed and Sealed this

Thirteenth Day of October, 1987

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,672,774

DATED : June 16, 1987

INVENTOR(S) : Villum B. K. Rassmussen

It is certified that error appears in the above-identified patent and that said Letters Patent is hereby corrected as shown below:

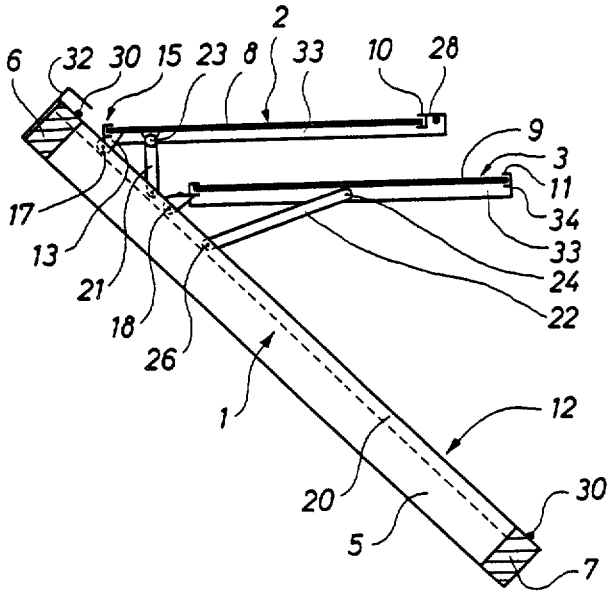

Fig. 5

UNITED STATES PATENT AND TRADEMARK OFFICE

CERTIFICATE OF CORRECTION

PATENT NO. : 4,672,774

DATED : June 16, 1987

INVENTOR(S) : Villum B. K. Rassmussen

It is certified that error appears in the above-identified patent and that said Letters Patent is hereby corrected as shown below:

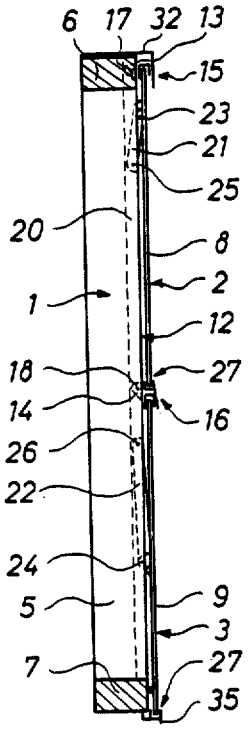

Fig. 6

UNITED STATES PATENT AND TRADEMARK OFFICE

CERTIFICATE OF CORRECTION

PATENT NO. : 4,672,774

DATED : June 16, 1987

INVENTOR(S) : Villum B. K. Rasmussen

It is certified that error appears in the above-identified patent and that said Letters Patent is hereby corrected as shown below:

On the title page, change the assignee from "V Kann Rasmussen & Co." to

--V. Kann Rasmussen Industri--

Signed and Sealed this

Twenty-third Day of August, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,672,774

DATED : June 16, 1987

INVENTOR(S) : Villum B. K. Rasmussen

It is certified that error appears in the above-identified patent and that said Letters Patent is hereby corrected as shown below:

On the title page, change the assignee from "V Kann Rasmussen & Co." to read --V. Kann Rasmussen Industri A/S--

This certificate supersedes Certificate of Correction issued August 23, 1988.

Signed and Sealed this

Twenty-fifth Day of July, 1989

*Attest:*

*Attesting Officer*

DONALD J. QUIGG

*Commissioner of Patents and Trademarks*